US008212846B2

(12) United States Patent
Li et al.

(10) Patent No.: US 8,212,846 B2
(45) **Date of Patent: *Jul. 3, 2012**

(54) DISPLAY CONTROL METHOD

(75) Inventors: Hung-Chun Li, Taipei County (TW); Mu-Shan Liao, Changhua County (TW); Tung-Hsin Lan, Taipei (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/940,055

(22) Filed: Nov. 5, 2010

(65) Prior Publication Data

US 2012/0032989 A1 Feb. 9, 2012

(30) Foreign Application Priority Data

Aug. 9, 2010 (TW) ..... 99126477 A

(51) Int. Cl.
*G09G 5/10* (2006.01)

(52) U.S. Cl. ..... 345/690; 345/89; 345/214

(58) Field of Classification Search ..... 345/1.1, 345/38–40, 46, 48, 50–51, 77, 82–84, 87–104, 345/204, 214, 690, 698–699
See application file for complete search history.

(56) References Cited

U.S. PATENT DOCUMENTS

| | | | | |
|---|---|---|---|---|
| 4,825,201 | A * | 4/1989 | Watanabe et al. | 345/2.1 |
| 7,064,740 | B2 * | 6/2006 | Daly | 345/102 |
| 7,113,163 | B2 * | 9/2006 | Nitta et al. | 345/102 |
| 7,370,979 | B2 * | 5/2008 | Whitehead et al. | 353/85 |
| 2009/0140665 | A1 | 6/2009 | Park | |

FOREIGN PATENT DOCUMENTS

| | | |
|---|---|---|
| TW | 200634377 | 10/2006 |
| TW | 200832320 | 8/2008 |
| TW | 200837692 | 9/2008 |
| TW | M352697 | 3/2009 |

* cited by examiner

*Primary Examiner* — William Boddie
*Assistant Examiner* — Mansour M Said
(74) *Attorney, Agent, or Firm* — Jianq Chyun IP Office

(57) ABSTRACT

A display controlling method is provided. The display controlling method includes following steps. A plurality of display data of a frame is received. The display data is analyzed to obtain a plurality of grayscale distributions corresponding to the display regions. According to the grayscale distributions, a backlight controlling signal for adjusting a brightness of each of the light emitting groups is generated. According to the backlight controlling signal, a plurality of interferences corresponding to the display data is obtained. According to the interferences, grayscales of the display data are correspondingly adjusted. Therefore, the optical interference of each of the pixels from the light emitting groups not corresponding to the pixels can be eliminated.

5 Claims, 6 Drawing Sheets

$$ICV=f(B11,BG1,X)+f(B11,BG3,X)+f(B11,BG4,X)$$

DISPLAY CONTROL METHOD

CROSS-REFERENCE TO RELATED APPLICATION

This application claims the priority benefit of Taiwan application serial no. 99126477, filed on Aug. 9, 2010. The entirety of the above-mentioned patent application is hereby incorporated by reference herein and made a part of this specification.

BACKGROUND OF THE INVENTION

1. Field of the Invention

The present invention relates to a controlling method and more particularly to a display controlling method which are capable of adjusting the brightness of a backlight module and the display data.

2. Description of Related Art

In recent years, since luminescence efficiency of light emitting diodes (LEDs) has been constantly upgraded, fluorescent lamps and incandescent bulbs are gradually replaced with the LEDs in some fields, such as a light source of a scanner which requires high reaction speed, a backlight source of a liquid crystal display (LCD), car dashboard illumination, traffic signs and general illumination devices. As for using the LEDs as the backlight source, the concept of the local dimming is added into the backlight source controlling process in order to decrease the power consumption of the backlight source and increase the dynamic contrast of the image.

Generally, the local dimming is applied onto the display panel which is divided into several display regions and the LEDs of the backlight module are divided into several light emitting groups for providing the necessary planar light sources respectively for the display regions. The brightness of the emitted light from each of the light emitting groups is adjusted according to the corresponding display regions. Hence, the brightness of the display regions is different from each other so that each of the display regions is interfered by the adjacent light emitting group, which leads to incorrect brightness of the displayed image.

In the current technology, only the display data corresponding to the edges of each of the display regions is adjusted according to the brightness of the light emitting groups adjacent to each of the edge pixels so as to decrease the interference of the adjacent light emitting groups. However, the display data mentioned above is adjusted only according to the brightness of the adjacent light emitting groups. Since the display panel is affected by each of the light emitting groups, the aforementioned adjustment of the display data is not thorough and the image is displayed with flaws.

SUMMARY OF THE INVENTION

The invention provides a display controlling method which are capable of obtaining the interferences respectively corresponding to the display data according to the brightness of each of the light emitting groups and adjusting the display data according to the interferences to eliminate the optical interference of the light emitting groups not corresponding to the display regions. Moreover, according to the grayscale distributions of the display regions, the brightness of the emitted light of the light emitting groups corresponding to the display regions are adjusted and the grayscales of the corresponding display data are adjusted.

The invention also provides a display controlling method for the aforementioned display controlling module. The display controlling method comprises the following steps. A plurality of display data of a frame is received. The display data is analyzed to obtain a plurality of grayscale distributions corresponding to the display regions. According to the grayscale distributions, a backlight controlling signal for adjusting a brightness of each of the light emitting groups is generated. According to the backlight controlling signal, a plurality of interferences corresponding to the display data is obtained. According to the interferences, grayscales of the display data are correspondingly adjusted.

According to one embodiment of the present invention, the display controlling method further comprises generating a plurality of data adjusting signals according to the grayscale distributions and correspondingly adjusting the grayscales of the display data corresponding to the display regions according to the data adjusting signals.

According to one embodiment of the present invention, the step for generating the data adjusting signals according to the grayscale distributions comprises determining a maximum distributed grayscale of each of the grayscale distributions according to each of the grayscale distributions, determining an adjustment gain corresponding to each of the grayscale distributions according to the maximum distributed grayscale corresponding to each of the grayscale distributions and generating the data adjusting signals according to the adjustment gains of the grayscale distributions.

According to one embodiment of the present invention, the step of generating the backlight controlling signal according to the grayscale distributions comprises adjusting the brightness of each of the light emitting groups according to the adjustment gains of the grayscale distributions and accordingly generating the backlight controlling signal.

Accordingly, the invention provides a display controlling method which are capable of obtaining the interferences respectively corresponding to the display data according to the brightness of each of the light emitting groups and adjusting the display data according to the interferences to eliminate the optical interference of the light emitting groups not corresponding to the display regions.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
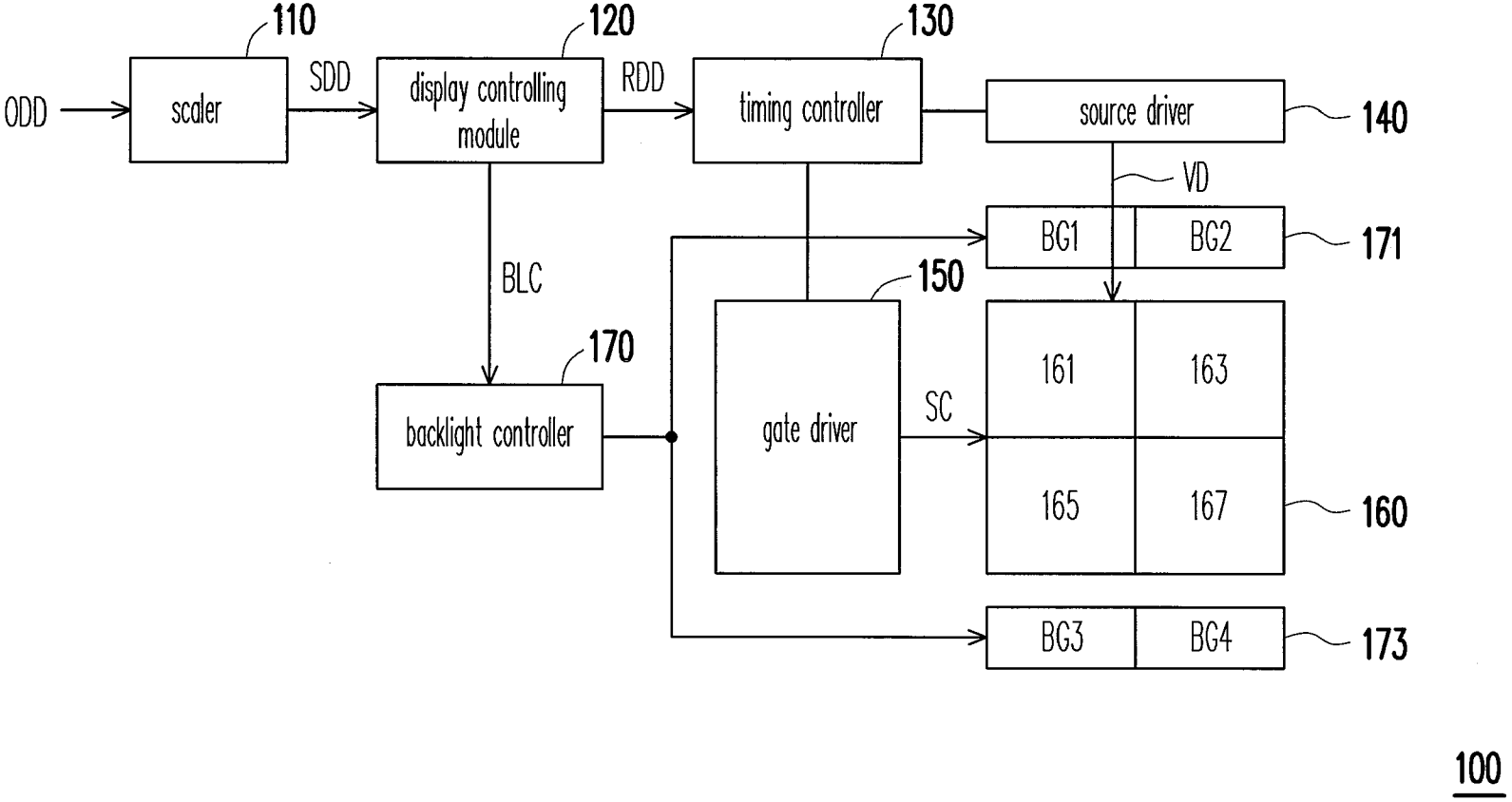
FIG. 1 is a schematic view of a display device according to one embodiment of the present invention.

FIG. 1 is a schematic view of a display device according to one embodiment of the present invention. As shown in FIG. 1, in the present embodiment, the display device 100 comprises a scaler 110, a display controlling module 120, a timing controller 130, a source driver 140, a gate driver 150, a display panel 160, a backlight controller 170 and backlight modules 171 and 173. The backlight modules 171 and 173 are side emitting type backlight modules and the backlight modules 171 and 173 respectively have a plurality of light emitting groups (such as BG1, BG2, BG3 and BG4). The display panel 160 is correspondingly divided into several display regions (such as 161, 163, 165 and 167). The planar light source is provided to each of the display regions by the corresponding light emitting groups. That is, the planar light source is provided to the display regions 161, 163, 165 and 167 by the light emitting groups BG1, BG2, BG3 and BG4 respectively.

The scaler 110 receives a plurality of original display data ODD of a frame and generates a plurality of scaled display data SDD of the frame according to the original display data ODD. The amount of the scaled display data SDD of the frame is corresponding to the amount of the pixels on the display panel 160. That is, each of the scaled display data SDD is corresponding to one pixel so that the scaled display data SDD is written into the corresponding pixel.

After the display controlling module 120 receives the scaled display data SDD of the frame, the grayscale distributions of the display regions 161, 163, 165 and 167 are analyzed according to the scaled display data. According to the grayscale distributions of the display regions 161, 163, 165 and 167, the display controlling module 120 correspondingly adjusts the brightness of each of the light emitting groups BG1, BG2, BG3 and BG4 and accordingly generates a backlight controlling signal BLC to the backlight controller 170, and, meanwhile, the grayscales of the scaled display data SDD corresponding to the display regions 161, 163, 165 and 167 are adjusted. Moreover, the display controlling module 120, according to the interference corresponding to each of the scaled display data SDD, is adjusted to generate a plurality of adjusted display data RDD.

The backlight controller 170 controls the brightness of each of the light emitting groups BG1, BG2, BG3 and BG4 according to the backlight controlling signal BLC. According to the adjusted display data RDD, the timing controller 130 controls the gate driver 150 outputting scanning signal SC to the display panel 160 so as to turn on each row of pixels of the display panel 160. Further, the timing controller 130 controls the source driver 140 outputting driving voltage VD corresponding to the adjusted display data RDD to the turn-on pixels of the display panel 160. When the pixels of the display panel 160 are all written with the driving voltage VD, the display panel 160 displays image with the light from the backlight modules 171 and 173.

It should be noticed that, in other embodiments, the display controlling module 120 can be integrated into the scaler 110 or the timing controller 130, which can be designed by the skilled artisan in the field, and the present invention is not limited by the descriptions made herein.

Figure 2:
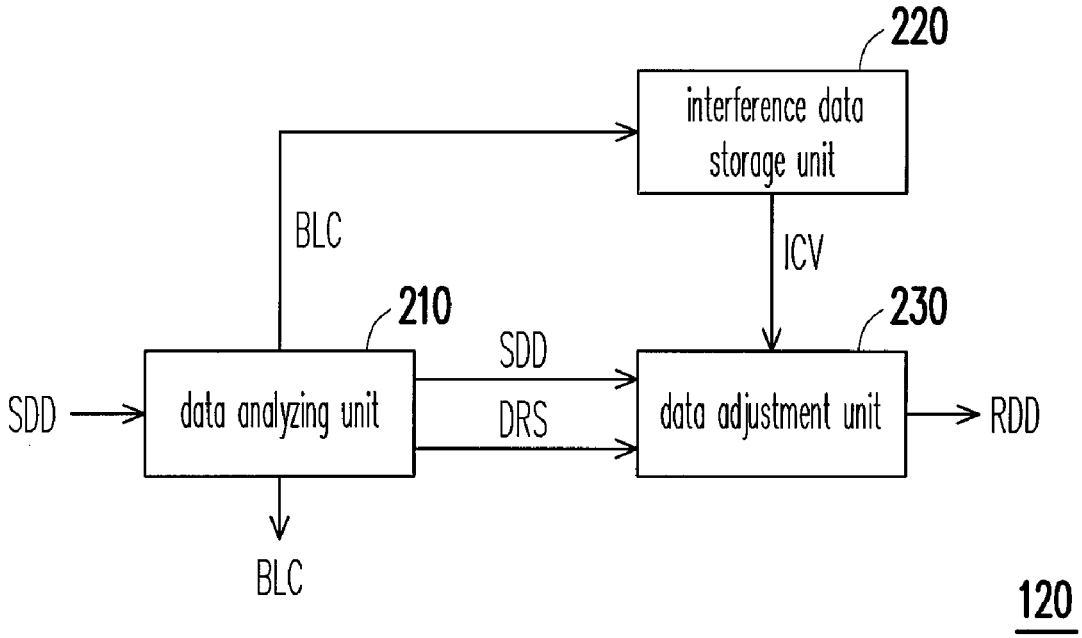
FIG. 2 is a schematic system view of a display controlling module 120 shown in FIG. 1 according to one embodiment of the present invention.

FIG. 2 is a schematic system view of a display controlling module 120 shown in FIG. 1 according to one embodiment of the present invention. As shown in FIG. 1 and FIG. 2, in the present embodiment, the display controlling module 120 comprises a data analyzing unit 210, an interference data storage unit 220 and a data adjustment unit 230. The data analyzing unit 210 receives a plurality of scaled display data SDD of a frame and analyzes the scaled display data SDD to obtain a plurality of grayscale distributions of the corresponding display regions 161, 163, 165 and 167 of the display panel 140. The data analyzing unit 210 generates a backlight signal BLC for adjusting a brightness of each of the light emitting groups BG1, BG2, BG3 and BG4 according to the grayscale distributions. Moreover, according to the grayscale distributions, the data analyzing unit 210 generates a plurality of data adjusting signals DRS to the data adjustment unit 230.

The interference data storage unit 220 is coupled to the data analyzing unit 210 and the interference data storage unit 220 outputs a plurality of interferences ICV of the corresponding scaled display data SDD according to the backlight controlling signal BLC. The data adjustment unit 230 is coupled to the data analyzing unit 210 and the interference data storage unit 220 so as to receive the scaled display data SDD, the data adjusting signals DRS and the interferences ICV. The data adjustment unit 230 correspondingly adjusts the grayscales of the scaled display data SDD corresponding to the display regions 161, 163, 165 and 167 according to the data adjusting signals DRS, and correspondingly adjusts the grayscales of the scaled display data SDD according to the interferences.

Figure 3A:
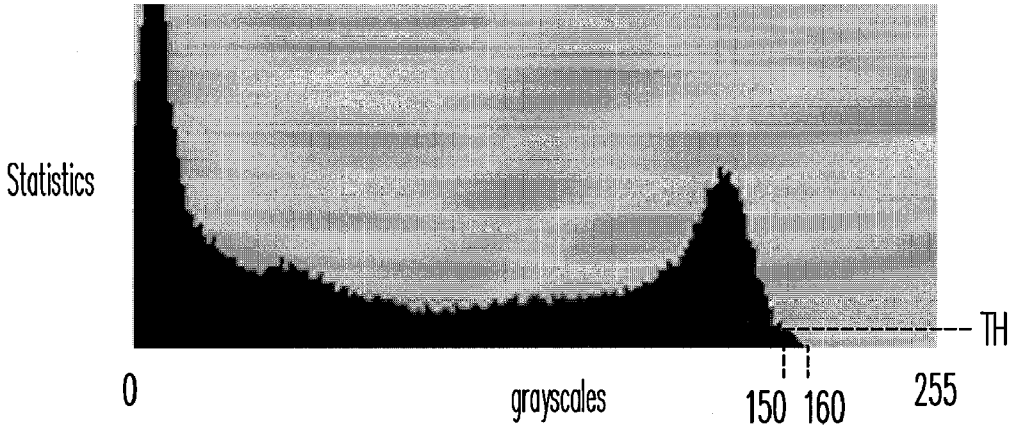
FIG. 3A is a diagram showing grayscale distribution of a display region 161 according to one embodiment of the present invention.
Figure 3B:
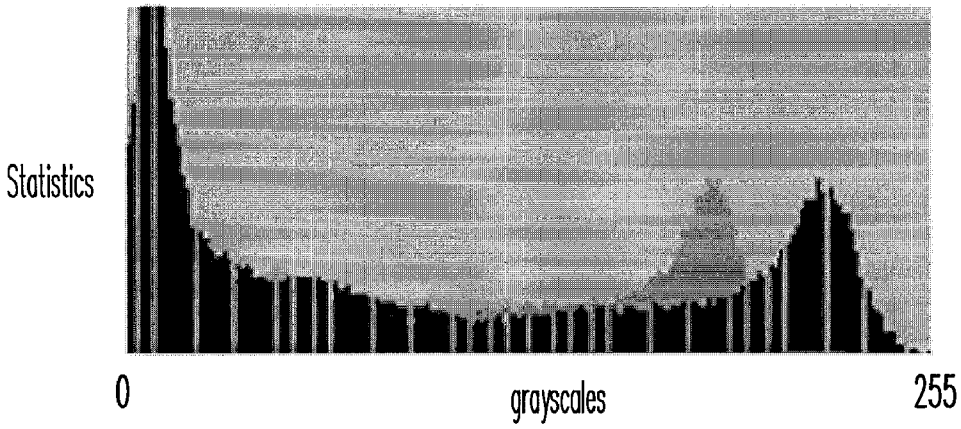
FIG. 3B is a diagram showing grayscale distribution of the expanded FIG. 3A.

FIG. 3A is a diagram showing grayscale distribution of a display region 161 according to one embodiment of the present invention. FIG. 3B is a diagram showing grayscale distribution of the expanded FIG. 3A. As shown in FIG. 3B, the grayscale distribution of the display region 161 in the present embodiment is taken as an example but not a limitation of the present invention. Furthermore, the adjustment procedure according to the grayscale distributions of the display regions 163, 165 and 167 is detailed in the following descriptions. In FIG. 3A, the statistics with respect to the grayscales from 0 to 255 are shown. According to the diagram, the maximum grayscale is 160 while the statistic is not zero. Therefore, in the present embodiment, the grayscale of 160 is the maximum distributed grayscale.

Then, the grayscales from 0 to 160 are expanded to be the grayscales from 0 to 255. That is, each of the grayscales from 0 to 160 is multiplied by a adjustment gain of 1.6 (which is about 255/160). In other words, the original grayscale of each of the scaled display data SDD is multiplied by the adjustment gain of 1.6 so that the range of the grayscale distribution is equal to the grayscales from 0 to 255 and the grayscale distribution is shown in FIG. 3B. That is, the data adjustment signals DRS in FIG. 2 is generated according to the adjustment gain so that the data adjustment unit 230 can expand the grayscale distribution shown in FIG. 3A.

Since the original grayscales corresponding the statistics are in a range from 0 to 160, some of the grayscales do not correspond to statistics after the original grayscales are expanded. After the original grayscales are expanded, the brightness of each of the scaled display data SDD is increased. In order that the display panel 160 displays the brightness of the original scaled display data SDD, the brightness of the corresponding light emitting group (i.e. BG1) is adjusted. For instance, when the brightness of the light emitting group BG1 is predetermined to be 100%, the brightness of the light emitting group BG1 can be adjusted to be 62.5% (i.e. 100%/1.6). Thus, not only the brightness of the original frame can be maintained but also the brightness of the light emitting group BG1 can be reduced to decrease the power consumption of the light emitting groups.

In addition, it is not easy to perceive the brightness variation of the relatively brighter portion of the frame. That is, it is not easy to perceive the grayscale difference between portions with the high grayscales. Hence, as shown in FIG. 3A, in the present embodiment, a threshold TH is set to determine the maximum distributed grayscale. Accordingly, since the statistics with respect to the grayscales from 151 to 160 are smaller than the threshold, the grayscales from 151 to 160 can be ignored without affecting the whole display of the frame. Moreover, since the statistic with respect to the grayscale of 150 is larger than the threshold, the grayscale of 150 can be regarded as the maximum distributed grayscale. The expanding of the grayscale distribution and the adjustment of the light emitting groups are similar to the procedures mentioned above and are not repeated herein. Since the maximum distributed grayscale is changed from 160 to 150, the adjustment gain is changed from 1.6 to 1.7. Hence, the brightness of each of the light emitting groups can be reduced to be 59% and the power consumption of the light emitting groups can be decreased.

Figure 4A:
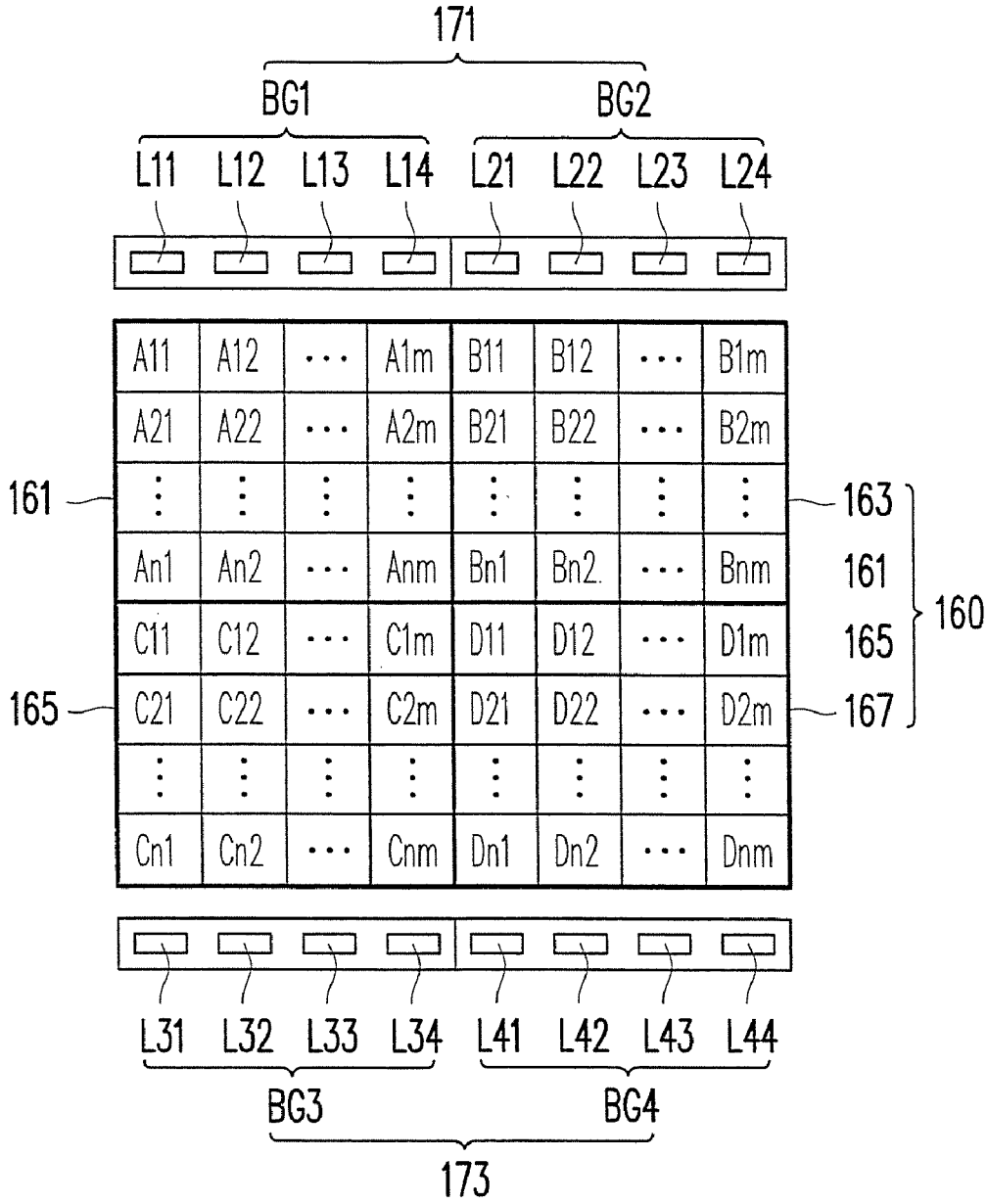
FIG. 4A is a schematic structural view showing a display panel 160 and backlight modules 171 and 173 shown in FIG. 1 according to one embodiment of the invention.

FIG. 4A is a schematic structural view showing a display panel 160 and backlight modules 171 and 173 shown in FIG. 1 according to one embodiment of the invention. As shown in FIG. 4A, in the present embodiment, each of the light emitting groups having four light emitting diodes is taken as an example. That is, the light emitting group BG1 has light emitting diodes L11~L14, the light emitting group BG2 has light emitting diodes L21~L24, the light emitting group BG3 has light emitting diodes L31~L34 and the light emitting group BG4 has light emitting diodes L41~L44. Each of the display regions has pixels arranged in an n×m array. That is, the display region 161 has pixels A11~Anm, the display region 163 has pixels B11~Bnm, the display region 165 has pixels C11~Cnm and the display region 167 has pixels D11~Dnm, and each of n and m is a positive integer.

When the frame is displayed, the light emitting diodes L11~L14 provide the required planar light source to the pixels A11~Anm. However, the planar light source provided by the light emitting diodes L11~L14 generates optical interferences to the pixels B11~Bnm, C11~Cnm and D11~Dnm. Similarly, the light emitting diodes L21~L24 provide the required planar light source to the pixels B11~Bnm. However, the planar light source provided by the light emitting diodes L21~L24 generates optical interferences to the pixels A11~Anm, C11~Cnm and D11~Dnm. Accordingly, each of the light emitting groups provides the required planar light source to the corresponding display region but also generates optical interference to other display regions. Hence, the light emitting groups BG1, BG2, BG3 and BG 4 are turned on sequentially so that the radiation interceptions of each of the pixels (such as A11~Anm, B11~Bnm, C11~Cnm and D11~Dnm) irradiated by the light emitting groups which are not corresponding to the target pixel is measured.

During the measurement, the brightness of the light emitting groups BG1, BG2, BG3 and BG4 is classified into x levels and the grayscale of each of the pixels A11~Anm, B11~Bnm, C11~Cnm and D11~Dnm is set to be 255. That is, the pixels A11~Anm, B11~Bnm, C11~Cnm and D11~Dnm are completely transparent. When the brightness of the light emitting groups BG1 is at level of 1, the radiation interception of the pixel B11 is f(B11,BG1,1), the radiation interception of the pixel B12 is f(B12,BG1,1), and others follow the same rules. Moreover, the representations of the radiation interceptions of the pixels C11~Cnm and D11~Dnm are similar to the aforementioned description and are not detailed herein. When the brightness of the light emitting groups BG1 is at level of 2, the radiation interception of the pixel B11 is f(B11,BG1,2), the radiation interception of the pixel B12 is f(B12,BG1,2), and others follow the same rules. When the brightness of the light emitting groups BG1 is at level of x, the radiation interception of the pixel B11 is f(B11,BG1,x), the radiation interception of the pixel B12 is f(B12,BG1,x), and others follow the same rules. When the brightness of the light emitting group BG1 is at other level, the radiation interceptions of the pixels can be obtain by following the aforementioned rule and are not detailed herein.

Thereafter, when the light emitting group BG2 is at different brightness level, the radiation interceptions of the pixels A11~Anm, C11~Cnm and D11~Dnm are measured. When the light emitting group BG3 is at different brightness level, the radiation interceptions of the pixels A11~Anm, B11~Bnm and D11~Dnm are measured. When the light emitting group BG4 is at different brightness level, the radiation interceptions of the pixels A11~Anm, B11~Bnm and C11~Cnm are measured. The radiation interceptions measured above can be stored in the interference data storage unit 220 shown in FIG. 2.

Figure 4B:
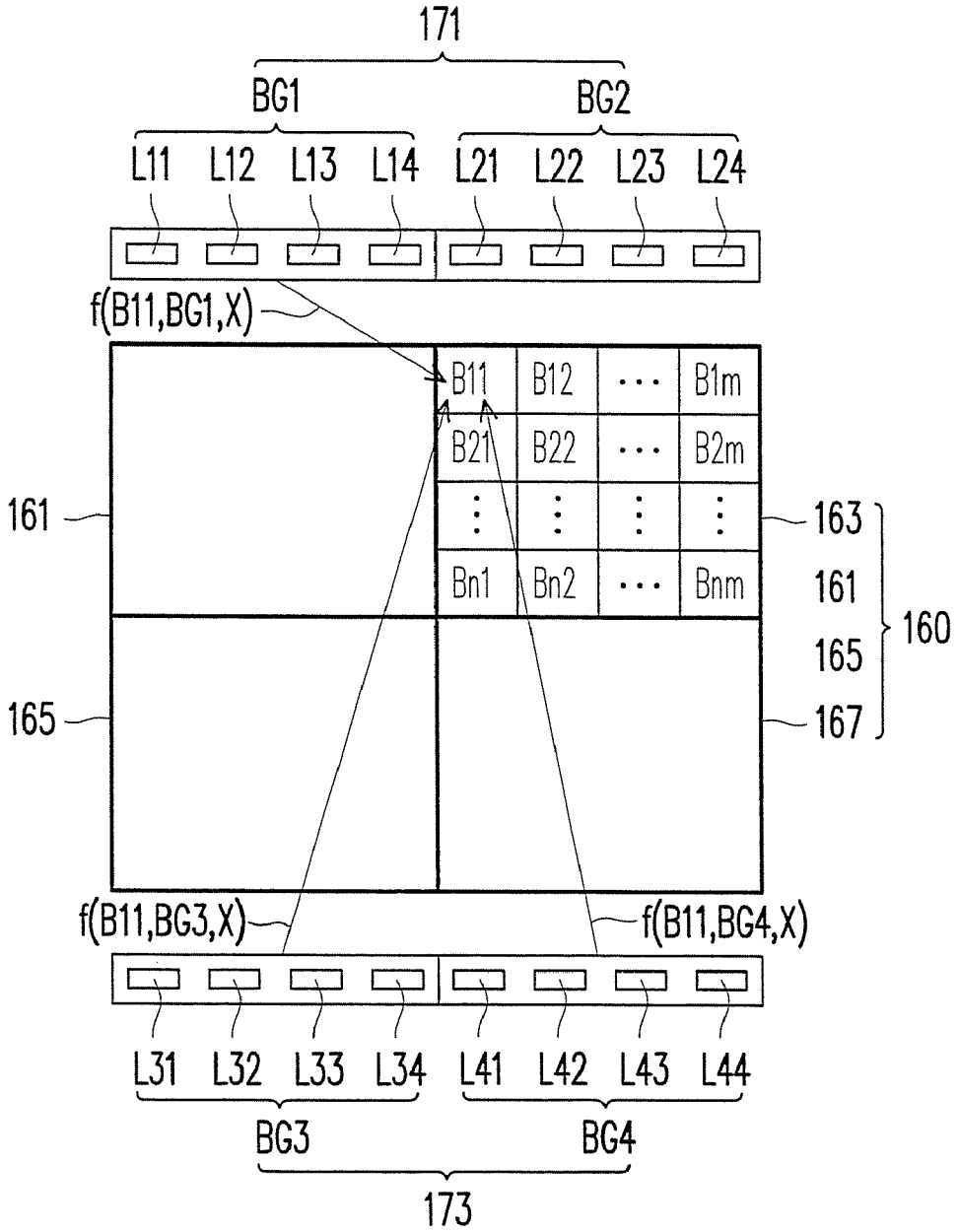
FIG. 4B is a schematic diagram showing a sum of radiation interceptions according to one embodiment of the invention.

FIG. 4B is a schematic diagram showing a sum of radiation interceptions according to one embodiment of the invention. As shown in FIG. 1 and FIG. 4B, when the frame is displayed and the scaled display data SDD is written into the pixel B11 and the brightness of each of the light emitting groups BG1, BG2, BG3 and BG4 is at level of x, the interference ICV corresponding to the scaled display data SDD is represented by the following equation: ICV=f(B11,BG1,x)+f(B11,BG3,x)+f(B11,BG4,x). If the interference ICV is equal to two grayscale degrees, the grayscale of the scaled display data SDD should be degraded for two degrees so that the display brightness of the pixel B11 is the brightness of the original frame. Thus, the optical interference can be compensated. The details of adjustment of other pixels can be referred to the above descriptions and are not described herein.

In addition, since the grayscale of the pixel is set to be 255 during the measurement and the grayscales of the pixels are different from each other according the scaled display data SDD during the frame is displayed, the adjusted grayscale can be further changed according to the displayed grayscale. When the grayscale of the scaled display data SDD is 150, the adjusted grayscale is: 2×150/255=1.17 (which is rounded up or down to one grayscale). That is, the scaled display data is further adjusted to be 149 so that the optical interference of the light emitting group which is not corresponding to the measured pixel can be decreased.

Figure 5:
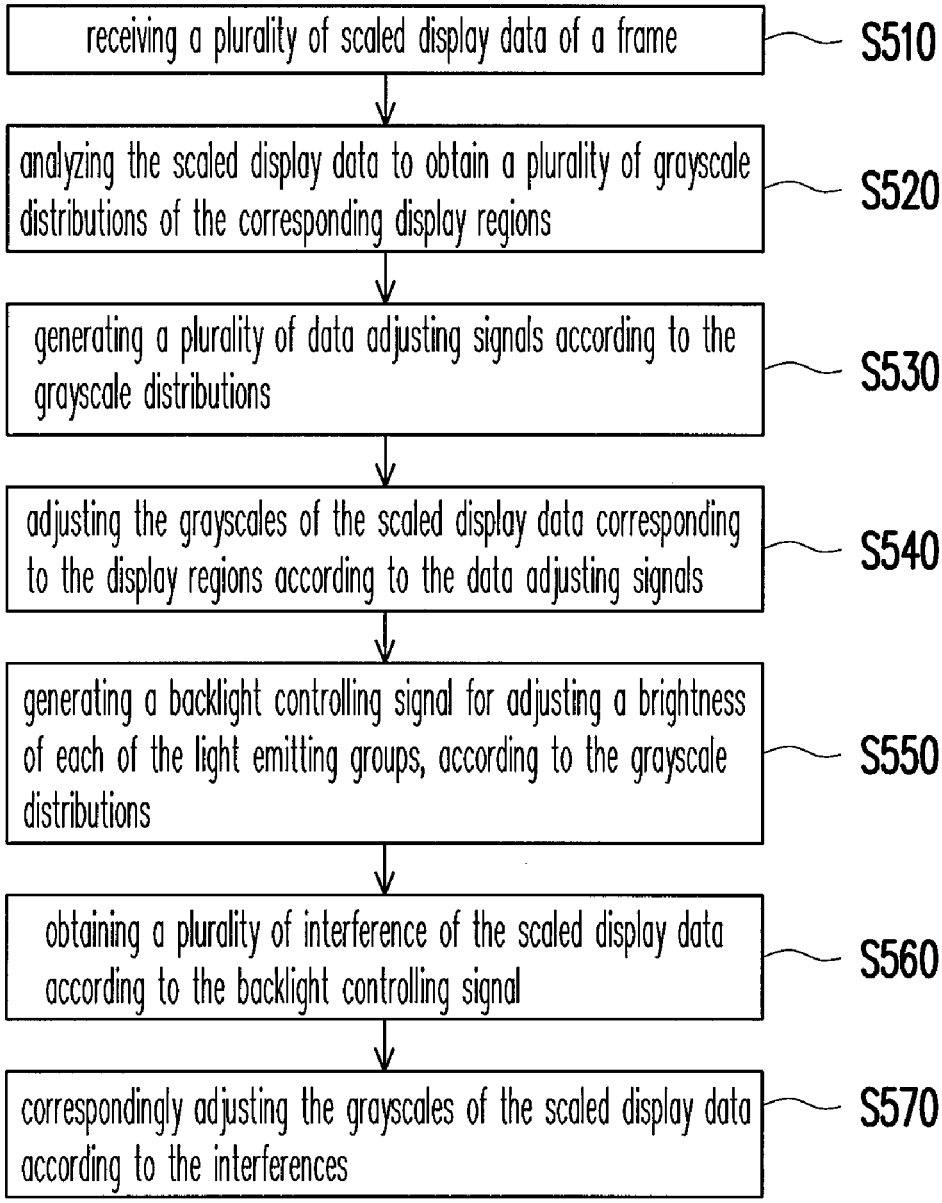
FIG. 5 is a flow chart illustrating a display controlling method according to one embodiment of the invention.

Accordingly, the above embodiment can be integrated as a display controlling method for the display controlling module 120. FIG. 5 is a flow chart illustrating a display controlling method according to one embodiment of the invention. As shown in FIG. 5, in the present embodiment, a plurality of scaled display data of a frame is received (step S510) and the scaled display data is analyzed to obtain a plurality of grayscale distributions of the corresponding display regions (step S520). A plurality of data adjusting signals are generated according to the grayscale distributions (step S530) and the grayscales of the scaled display data corresponding to the display regions are adjusted according to the data adjusting signals (step S540). Furthermore, according to the grayscale distributions, a backlight controlling signal for adjusting a brightness of each of the light emitting groups is generated (step S550). A plurality of interference of the scaled display data are obtained according to the backlight controlling signal (step S560) and the grayscales of the scaled display data are correspondingly adjusted according to the interferences (step S570). The details of each of the steps can be referred to the above descriptions and are not described herein.

Accordingly, the embodiment of the invention provides a display controlling method which are capable of obtaining the interferences respectively corresponding to the scaled display data according to the brightness of each of the light emitting groups and adjusting the scaled display data according to the interferences to eliminate the optical interference of the light emitting groups not corresponding to the display regions. Moreover, according to the grayscale distributions of the display regions, the brightness of the emitted light of the light emitting groups corresponding to the display regions are adjusted and the grayscales of the corresponding scaled display data are adjusted. Thus, when the maximum distributed grayscale is not equal to the maximum grayscale, the brightness of the light emitting group can be reduced to decrease the power consumption of the light emitting groups.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A display controlling method for a display device having a backlight module and a display panel, wherein the backlight module has a plurality of light emitting groups and the display panel has a plurality of display regions, the display controlling method comprising:

receiving a plurality of display data of a frame;

analyzing the display data to obtain a plurality of grayscale distributions corresponding to the display regions;

according to each of the grayscale distributions, determining a maximum distributed grayscale of each of the grayscale distributions;

according to the maximum distributed grayscale corresponding to each of the grayscale distributions, determining an adjustment gain corresponding to each of the grayscale distributions;

according to the adjustment gains of the grayscale distributions, generating a plurality of data adjusting signals;

according to the data adjusting signals, adjusting grayscales of the display data corresponding to the display regions;

according to the grayscale distributions, generating a backlight controlling signal for adjusting a brightness of each of the light emitting groups;

according to the backlight controlling signal, obtaining a plurality of interferences corresponding to the display data; and according to the interferences, correspondingly adjusting the grayscales of the display data.

2. The display controlling method of claim 1, wherein each of the interferences is a sum of radiation interceptions of a pixel irradiated by a portion of the light emitting groups which are respectively corresponding to a plurality of pixels adjacent to the pixel to be written by the corresponding display data.

3. The display controlling method of claim 1, wherein the adjustment gain is a ratio of a maximum grayscale to the maximum distributed grayscale.

4. The display controlling method of claim 1, wherein a statistic of the maximum distributed grayscale is larger than a threshold.

5. The display controlling method of claim 1, wherein the step of generating the backlight controlling signal according to the grayscale distributions comprises:

according to the adjustment gains of the grayscale distributions, adjusting the brightness of each of the light emitting groups and accordingly generating the backlight controlling signal.

* * * * *